US005868578A

United States Patent [19]

Baum

[11] Patent Number: 5,868,578

[45] Date of Patent: Feb. 9, 1999

[54] SPORTS ANALYSIS AND TESTING SYSTEM

[76] Inventor: Charles S. Baum, 360 Knollwood, Traverse City, Mich. 49686

[21] Appl. No.: 717,549

[22] Filed: Sep. 20, 1996

Related U.S. Application Data

[60] Provisional application No. 60/004,291 Sep. 21, 1995.

[51] Int. Cl.[6] ..... A63B 69/00

[52] U.S. Cl. ..... 434/247; 482/902; 434/257; 473/453

[58] Field of Search ..... 473/453, 452, 473/454; 434/247, 252, 257; 482/1–9, 900–902

[56] References Cited

U.S. PATENT DOCUMENTS

| | | | |
|---|---|---|---|
| 4,029,315 | 6/1977 | Bon . | |
| 4,070,018 | 1/1978 | Hodges . | |
| 4,309,032 | 1/1982 | Facius . | |
| 4,461,477 | 7/1984 | Stewart . | |
| 4,563,005 | 1/1986 | Hand et al. . | |
| 4,577,863 | 3/1986 | Ito et al. . | |
| 4,759,219 | 7/1988 | Cobb et al. . | |
| 4,858,922 | 8/1989 | Santavaci . | |
| 4,870,868 | 10/1989 | Gastgeb et al. | 473/457 |
| 4,915,384 | 4/1990 | Bear . | |
| 5,056,783 | 10/1991 | Matcovich et al. | 473/453 |
| 5,249,967 | 10/1993 | O'Leary et al | 434/247 |

*Primary Examiner*—Richard J. Apley
*Assistant Examiner*—Glenn Richman
*Attorney, Agent, or Firm*—Gifford, Krass, Groh, Sprinkle, Patmore, Anderson & Citkowski

[57] ABSTRACT

A sports analysis and testing system includes a plurality of high-speed digital video cameras, each aimed at a player from a different perspective to record their movements and those of a ball in play. In a baseball application, a programmed computer interfaced to the video cameras and various optional sensors includes application software to generate performance statistics as a function of the pitch, hit, and bat swing. If previously obtained batter performance data are available, the system may also be used to generate a database containing historical performance statistics, including real-time measurements of many characteristics, including pitched and batted ball speeds and trajectories, bat swing timing, speeds, and swing angles, location over the plate, and ball-bat contact location.

13 Claims, 11 Drawing Sheets

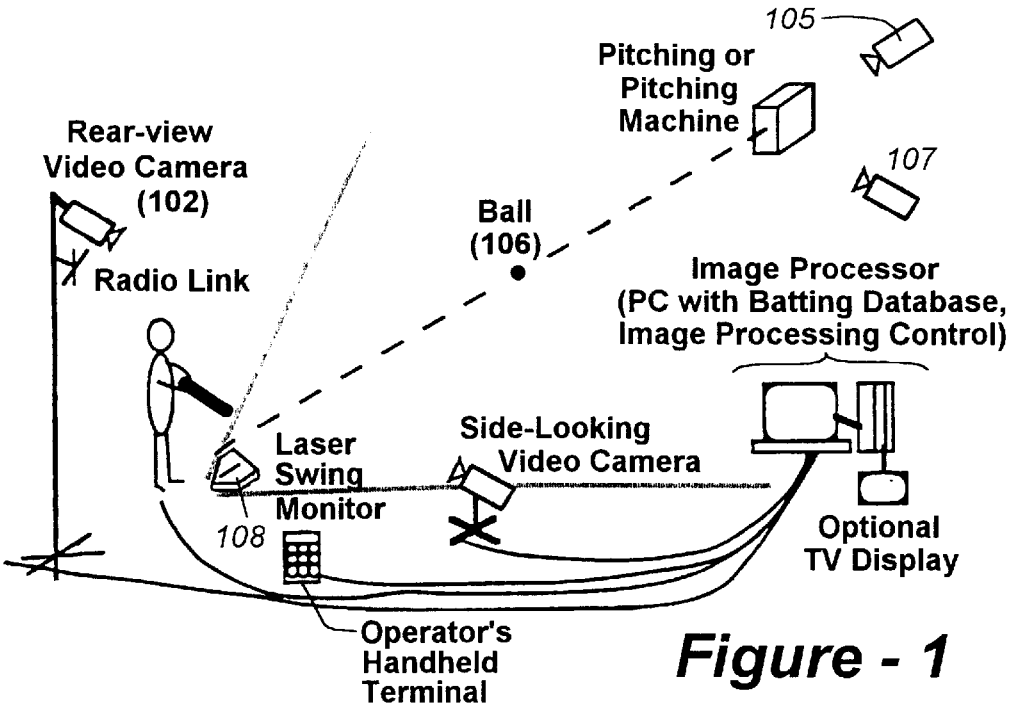
Figure - 1
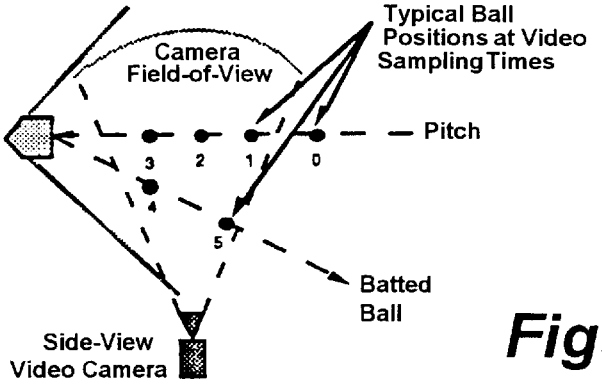
Figure - 2
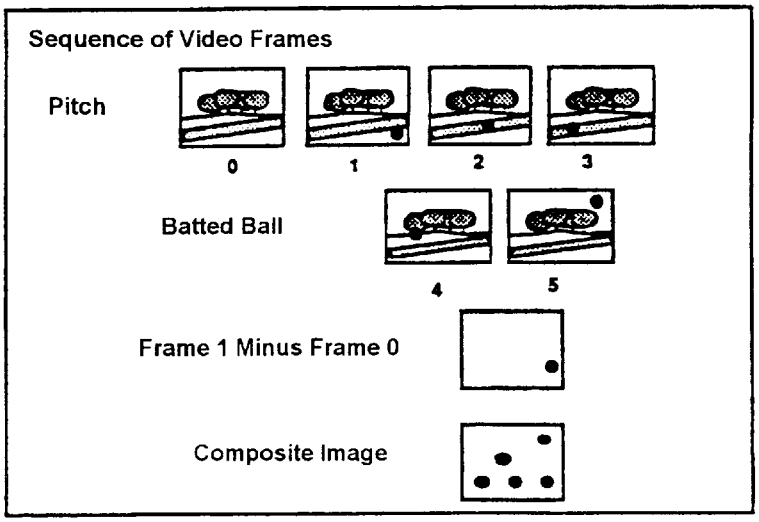

BAUM RESEARCH AND DEVELOPMENT CO., INC.

| *HITTER* | ☐ *lh* ☐ *rh* | *#* | *camera deviation* | *team* | *camera* | *i.d.#* | *date* |
|---|---|---|---|---|---|---|---|

| # | *SPECIFIC POINT OF OBSERVATION* | *milli-seconds* | *pitch location* | *speeds f.p.s.* |
|---|---|---|---|---|
| 1 | Follow thru complete 100-75-50-25-NIL | | | |
| 2 | Contact location from plate | | | |
| 3 | Contact time | | | |
| 4 | Rear foot at contact/off ground/toe drag/planted | | | |
| 5 | Contact arm extension angle - 0-45-90 | | | |
| 6 | Body vertical contact angle - 110-100-90-80-70-60 | | | |
| 7 | Bat at zero camera angle | | | |
| 8 | Ball speed at contact | | | |
| 9 | Bat speed at contact | | | |
| 10 | Ball speed off bat + hit position - 3-5-7-9-11 in. | | | |
| 11 | Body anti-recoil force at contact | | | |
| 12 | Body horizontal angle contact position - 110,90,70 | | | |
| 13 | Body speed at contact | | | |
| 14 | First rotation of shoulder | | | |
| 15 | First hip rotation | | | |
| 16 | COMMITMENT - rear hands foreword mvt. Point | | | |
| 17 | Rear foot off ground | | | |
| 18 | Front foot land | | | |
| 19 | Angle of front foot - 90-45-0 | | | |
| 20 | First body movement fwd. | | | |
| 21 | Initial movement to perch - weigh transfer back | | | |
| 22 | Start of study | | | |
| 23 | Reverse forces present - start of backswing down | | | |
| 24 | Reverse forces present - start of backswing up | | | |
| 25 | Actual swing time - reaction time | | | |

Comments:

Hitting style-rotation only no stride, front foot one hand release, hands back stop stride.

*Figure - 8*

| INPUT DATA AND MEASUREMENTS |
|---|
| **Typical Historical Data**<br>Pitcher: I.D. Performance Data<br>Batter: I.D. Performance Data<br>Bat: Specification: sweetspot location |
| **Typical Measured Data**<br>Pitch<br>• Ball Speed In<br>• Result: Take or swing; strike, ball, foul, hit<br>• Number of swings<br>Hit<br>• Type<br>• Ball Speed Out<br>• Distance, location (trajectory)<br>Bat<br>• Bat Speed<br>• Angle of Swing<br>• Vibration Response<br>• Location of ball-bat contact |
| **Typical Results**<br>• Bat speed differences by bat type, length, weight, and balance<br>• Turnaround ratio: Ball speed out over ball speed in<br>• Field hits<br>• Batting average<br>• Misses vs. types of pitch<br>• Distance of hits and types: long ball, liners, bloopers<br>• Location of hits - pull hitter-opposite-center-spray<br>• Amount of hits over threshold levels: 200-250-300-350-400 feet<br>• Power swing data: compare ball speed out by batting weight, etc.<br>• Number of hits per strikes<br>• Number of misses per strikes<br>• Number of hits/misses per strike vs. fastball and curve<br>• Performance at pitch levels of 75, 85, 95 MPH<br>• Swing strength: speed out over bat speed<br>• Comparisons of ability vs. bat type<br>• Ability to hit on sweetspot<br>• Hitting angle upswing degrees vs. type of pitch and hit/miss<br>• Compute simulated swing profile<br>• Determine best bat for hitter<br>• Batter performance prediction<br>• Compute pro profile expected batting average<br>• Specific list of weakness areas to correct<br>• Use data to improve on weak areas for all players<br>• Use video with overlays from computer for scout/management decision<br>• Determine with 90% probability type of hitter<br>• Use sequential tests to determine improvements |

*Figure - 9*

BATTING SYSTEM
SEQUENCE OF EVENTS: SINGLE PITCH

| TIME (Secs) | EVENT |
|---|---|
| 0:00 | Windup starts |
| 1:00 | Pitch thrown |
| 1:40 | Pitch transits video sensors |
| | Fields of view, frames sent to computer |
| 1:44 | Bat passes through laser sensor |
| 1:44 | Ball is hit |
| 1:46 | Ball passes through video sensors |
| | Fields of view, frames sent to computer |
| 1:60 | Bat swing parameters determined, sent to computer |
| 7:00 | Video frames analyzed, ball velocities and directions determined |
| 7:20 | At-bat statistics calculated, entered into database |
| 7:30 | System ready for next pitch |

Data acquisition timeless than 10 seconds

*Figure - 10*

SPORTS ANALYSIS AND TESTING SYSTEM

REFERENCE TO RELATED APPLICATION

This application-claims priority of U.S. provisional application Ser. No. 60/004,291, filed Sep. 21, 1995, the entire contents of which are incorporated herein by reference.

FIELD OF THE INVENTION

The present invention relates generally to sports analysis and training systems, and, more particularly, to an analysis and testing system which may be used to track ball and player movements, create a performance database, including historical statistical information, and perform other useful functions.

BACKGROUND OF THE INVENTION

There is an outstanding need in professional sports to identify players with the potential for development, and to provide training tools to improve the performance of existing players. Currently, the development, training and evaluation of players are almost completely dependent on the experience and observations of managers, coaches, and scouts. These observations are supported only by an extensive historical database of performance statistics. Other than radar guns to measure ball velocity and video cameras for playback viewing, there are no quantitative measures of ball movements, player performance, etc. The need remains, therefore, for an analysis and testing system which may be used to track activities in a variety of different sports for the purpose of creating performance databases, and present data for a variety of analytical and/or statistical evaluations.

SUMMARY OF THE INVENTION

The present invention may be used to provide management, coaches and players with the information they need to predict professional levels of play, improve and maintain skills, select players to meet game situations and team requirements, and make decisions on player signing, release or trade. The system is applicable to a variety of different sports, particularly ball-oriented sports, including baseball, softball, tennis, golf and any other situation wherein a player strikes an object, whether thrown, pitched or returned. In a baseball application, for example, the system may be used to effectively and instantaneously diagnose a hitter, a pitcher, or the hitter/pitcher combination, provide all relevant information on how the player(s) react, and give a professional baseball team a complete dossier on what a each player can do.

In terms of apparatus, a baseball-oriented analysis and testing system according to the invention includes a plurality of high-speed digital video cameras, each aimed at a batter and/or pitcher from a different perspective to record the pitch and hit of a ball by the batter. In the preferred embodiment, a first video camera is trained down on the hitter from above, while a second camera views the hitter from the side, and software is provided to isolate the movement of the ball from background scenery. In a more comprehensive environment, one or more video cameras are also trained on the pitcher, for example, including a camera positioned behind the pitcher so as to include the hitter in the camera's field of view, with the recordings made by all cameras being synchronized to obtain an accurate, three-dimensional record of ball and player movements for later analysis. The ball and/or player movements may be isolated from background scenery either through the use of software which compares changes between frames so as to deduce such movements, or, alternatively, an operator may mark with a pointing device those points on a player, or the ball itself, thus instructing the system to track those points, which may include multiple points on each player, similar to systems used in tracking dummies during the performance of crash testing.

A monitor, preferably in the form of a plurality of interruptable light beams, may be employed as a bat-swing monitor. A programmed computer interfaced to the video cameras and to the bat swing monitor, if utilized, includes application software to generate player performance statistics as a function of the pitch, hit, and bat swing. A memory is preferably provided for storing previously obtained player performance statistics, enabling the system to generate a database of history performance data.

In the preferred embodiment, the system also includes a vibration sensor mounted on a player implement, the bat, for example, and interfaced to the computer, enabling the performance statistics to include vibration, including a determination as to the hit of the ball relative to the "sweet spot" of the implement. So as not to interfere with the user's movements, the interface between the vibration sensor and the computer preferably includes a wireless communication link.

In operation, in a baseball environment, a ball is pitched to the batter, either by a human pitcher or through the use of mechanical pitching means. The movements of the batter, and/or pitcher and the ball just prior to, during, and following contact of the ball by the bat, are imaged by the various cameras and information is stored relating to the player and ball movements. The swing of the bat is also monitored to determine additional bat-swing characteristics, including bat speed, and such characteristics are stored as well. The point of contact between the ball and the bat may also be sensed along with the storage of representative contact data. A database of player performance statistics based upon the pitch, swing and ball-contact information is then developed and preferably display on an associated display in response to an operator request. A typical database preferably includes an extensive list of parameters, as detailed in the table of FIG. 9.

BRIEF DESCRIPTION OF THE DRAWINGS

The file of this patent contains at least one drawing executed in color.

FIG. 1 is a side-view schematic illustration depicting various hardware aspects of the invention;

FIG. 2 is a two-part drawing used to convey how vertical characteristics and pitch and batted ball are measured according to the invention;

FIG. 8 is a table which lists a number of steps which may be used to analyze batter performance;

FIG. 9 is a table which provides an extensive list of evaluation parameters that may be included in a typical database generated to the invention;

FIG. 10 is a table which provides a sequence of events for a single pitch or hit.

DETAILED DESCRIPTION OF THE PREFERRED EMBODIMENT

Figure 3:
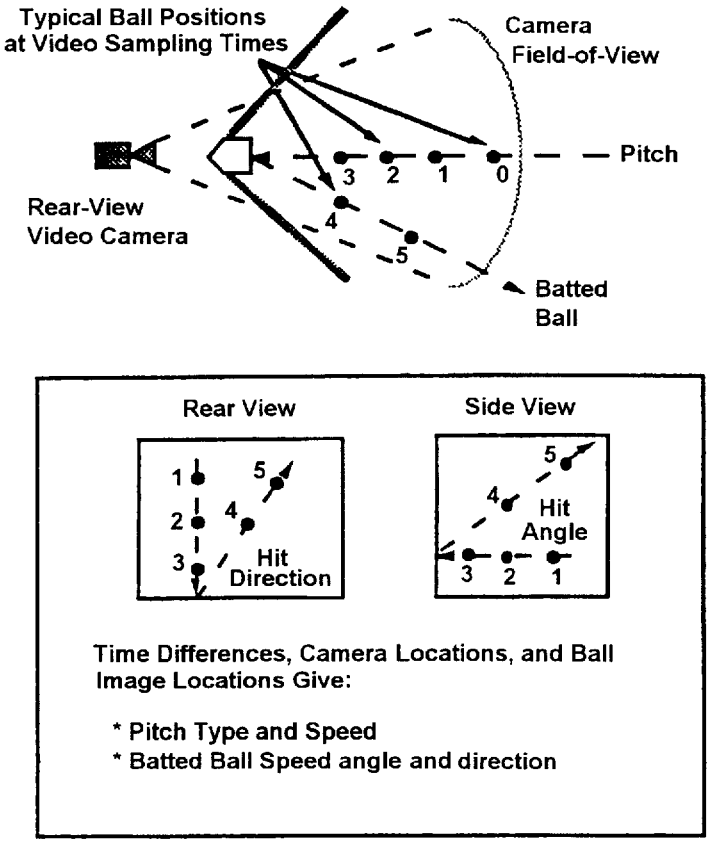
FIG. 3 is a two-part illustration used to illustrate how video imaging from above provides simultaneous measurement of ball positions in a horizontal plane according to the invention.

The present invention provides apparatus and methods involving hardware and software aspects to instantaneously diagnose ball and/or player movements associated with a sports-related activity, followed by the development of a database of performance statistics, which may also include historical data. As mentioned, the system is applicable to a wide variety of situations, particularly ball-oriented sports though it may also be used for non-ball activities, and even in contact-type sports. Thus, though the following description will concentrate on the use of methods and apparatus according to the invention in relation to a baseball situation, the other potential uses of the teachings herein should be kept in mind as applicable extensions.

In a baseball environment, then, the system may be used to provide all relevant information on how the hitter and/or pitcher move, including all relevant steps associated with the pitch and hit of the ball, including all relevant movements of the ball itself. In terms of hardware, the system may include at least two video cameras 102 and 104 to measure the pitch and batted ball 106, at least two cameras 105 and 107 to measure pitcher movements (if an automatic pitching machine is not used), a sensor 108 to measure the batter's swing, a bat-mounted sensor (not visible in the figure) to measure the location of contact along the bat, and a computer system 110 incorporating software to analyze measurements and generate a database containing measurements and completed analyses. Each device is continuously monitored by the computer system 110, and once the devices are set out in the evaluation area, all devices make completely automatic measurements of each pitch and hit without any action of the operator.

The video cameras are preferably high-speed digital type cameras facilitating recording at a rate of 1,000 frames per second or greater. Such cameras, which may be purchased from the Kodak Company as Model Ektapro may be used to measure all pitched and batted ball characteristics, including speeds, pitcher movements, pitch type, location at the batter, and direction of hit. The cameras may be set up to view the field in front of the batter from overhead and from the side, as shown in FIG. 1. The overhead camera 102 allows a planned view of the field and measurement of pitch, movement relative to the plate and batted ball direction in fair territory. The side view camera 104 provides the measurement of downward pitch movement, of pitch speed and of batted ball speed and angle. Camera 107 is preferably positioned to view the human pitcher from the side, whereas camera 105 is preferably placed behind the pitcher so as to include the player in the field in the view, and may be used with both a human pitcher and pitching machine. Together, the two cameras allow both the pitch and hit to be "tracked".

The following discussion will concentrate on the way in which a plurality of cameras are coordinated to track batter movements with the understanding that similar principals are used to track and coordinate pitcher movements, as appropriate.

FIGS. 2 and 3 illustrate the techniques used with the video system to measure the pitch and batted ball parameters. In FIG. 2, the top sketch shows a sequence of positions of the pitch, viewed from above (position 0, 1, 2 and 3) and of the hit (positions 4 and 5), in this case a hit to right field. While position 0 is not seen by the camera, the camera does see all other ball positions.

The sequence of video pictures or frames seen by the side-view camera for ball position 0 through 5 is shown in the sketches in the bottom of FIG. 2. In frame 0 the camera sees the background but no ball. In all other frames, the camera sees both the background and the ball, with the ball appearing in different locations as it passes by the camera. In frames 1, 2 and 3, the pitch passes in front of the camera from right to left. The batted ball, seen in frames 4 and 5, pass from left to right.

In a preferred embodiment, the ball is isolated from the background using an image processing technique similar to those utilized in radar systems. This technique eliminates all parts of the image which do not change from frame to frame, i.e., the background, and leaves the part of the image which does change position from frame to frame, i.e., the ball. The process, as is commonly known by those skilled in the art of image processing, works by subtracting the image of one frame from the image in the frame directly following it. That is, the image in frame 0 is subtracted from 1. This leaves the differenced image shown as "frame 1 minus frame 0", as illustrated in the lower section of FIG. 2. Repeating the process for all frames and adding the results together provides the "composite image" shown in FIG. 2 showing all ball positions as seen by the side view camera for a single pitch and hit. Using geometry, the composite image, and the timing of the frames, the ball speed and upward angle of the hit may be determined.

As an alternative, or for use in conjunction with the ball-isolation technique just described, the system may also support point identification and tracking. More specifically, a pointing device such as a cursor may be used to click on any points of a player to be recorded, or the ball itself, from which point those identified areas will be monitored to provide a measure of their movement, in isolation. Such techniques, which are known in the art of crash testing, for example, are quite reliable, particularly if the "marked" points are sufficiently discernable on a frame-by-frame basis. Also similar to crash testing applications, according to the invention, multiple points of multiple players ma be marked for isolation purposes, including a pitcher's elbow, a batter's knee, and so forth.

FIG. 3 shows the same sequence of ball positions as seen within the field of view of the overhead camera 102. The frames taken by the overhead camera are synchronized with those taken by the side-view camera. The same differencing processing is preferably carried out with the frames from the overhead camera to provide another composite image. The composites are combined by the computer to provide locations of the ball at the time of each frame in 3 dimensions. These locations are then used to determine the type of pitch, pitch speed and position of the ball relative to the strike zone, and batted ball speed, angle and direction.

A hitter, filmed at high speed, proceeds through a normal hitting sequence which is broken down into steps shown in the table of FIG. 8. The film is digitized and analyzed by software, and the resulting data is then available in the database and may be viewed by interested parties in a variety of formats.

Figure 4:
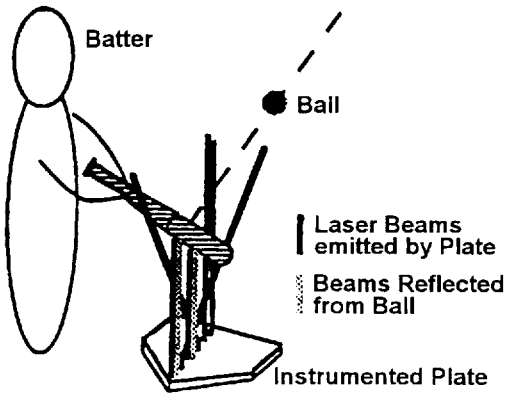
FIG. 4 is an oblique drawing which shows how bat speeds before and after a hit and swing angle and height are determined from the timing of reflections of laser beams from the bat as it passes over a swing monitor.

Although not necessary to the invention, a laser system (FIG. 4) may be used to measure swing characteristics, including bat speed before and after contact, swing angle and height of the bat above the plate. This laser swing monitor may be located on the plate, such that when the batter swings at the ball, his bat passes over the swing monitor, passing through the light beams of several lasers. The timing of the bat cutting through the lasers allows the bat speed to be measured before and after the hit. It also allows measurement of the height of the swing and the angle of the swing.

The swing monitor may be similar to that disclosed in U.S. Pat. No. 4,577,863 to S. Ito. The apparatus is housed in a plate approximately 2" thick and contains a plurality of lasers and light detectors. Optimally, six lasers and light detectors may be used. The monitor is placed over home plate during the batter testing. As the batter swings, the bat crosses through the lasers. At each laser, light reflects off the bat back to a light detector which determines the time of the crossing very precisely. The sequence of times from the several lasers provides sufficient information to calculate the speed of the bat both before and after the ball is hit, as well as the height of the bat above the plate and the swing angle.

Figure 5:
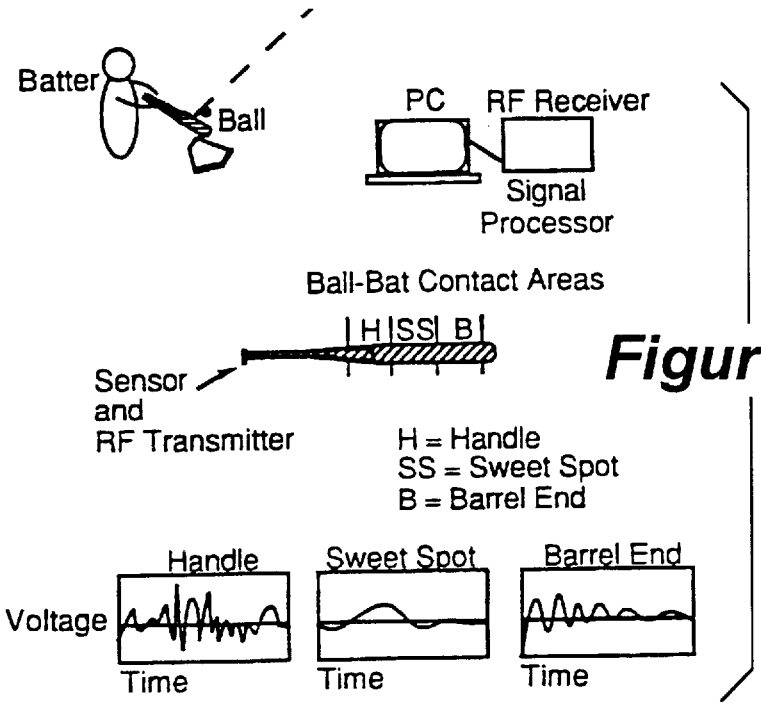
FIG. 5 is a multi-part drawing which shows how a miniature sensor attached to the knob end of the bat may be used to measure vibration after a hit, and how the characteristics of the sensed vibration may be used to determined where the ball hit the bat.

Now making reference to FIG. 5, a sensor, mounted on the bat, is preferably utilized to measure the location of ball contact on the bat. Preferably, a miniature sensor is mounted on the knob of the bat. On ball contact, the bat sensor measures the vibration of the bat and radios the vibration to an analyzer. The analyzer determines if the batter hit the ball on the "sweet spot" or more toward the end of the barrel or toward the handle. This measurement makes use of the fact that handle vibration or sting for a "sweet spot" hit is much less than for a hit off the handle or the end of the barrel. When contact is made, the vibration is radioed to an analyzer interfaced to the computer system, which compares the details of the vibration to previous measurements of vibration taken when the bat was hit with a hammer or other object in the three locations shown. Vibrational characteristics are sufficiently different that hit location is unambiguous. While the sensor and radio transmitter may be affixed to the knob, location of the sensor and transmitter may vary along the length of the bat. Given pitch, swing and contact data, the actual database development and performance analysis is accomplished with a computer and software. The table of FIG. 10 shows the timing of a typical measurement sequence for a single pitch.

Figure 6:
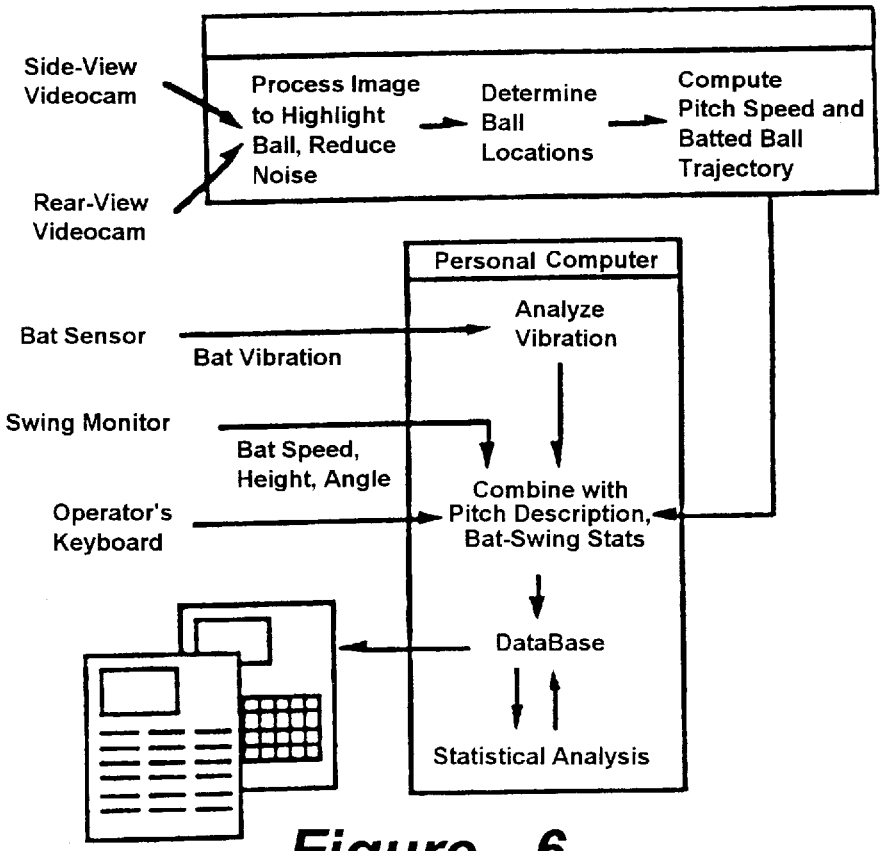
FIG. 6 is a combined block diagram and functional diagram used to show how an image processor and portable personal computer may be used to make measurements and construct a batter performance database according to the invention.
Figure 7:
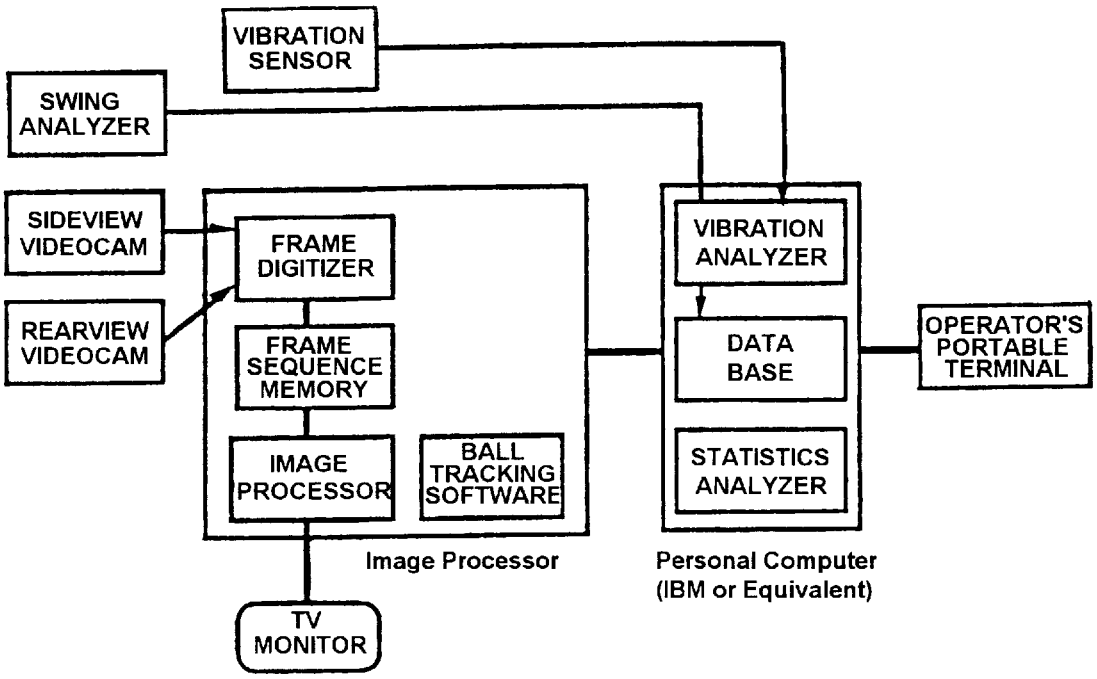
FIG. 7 is a block diagram which illustrates how hardware and software components may be integrated according to the invention to produce a system for measuring pitch and batted ball parameters.
Figure 11A:
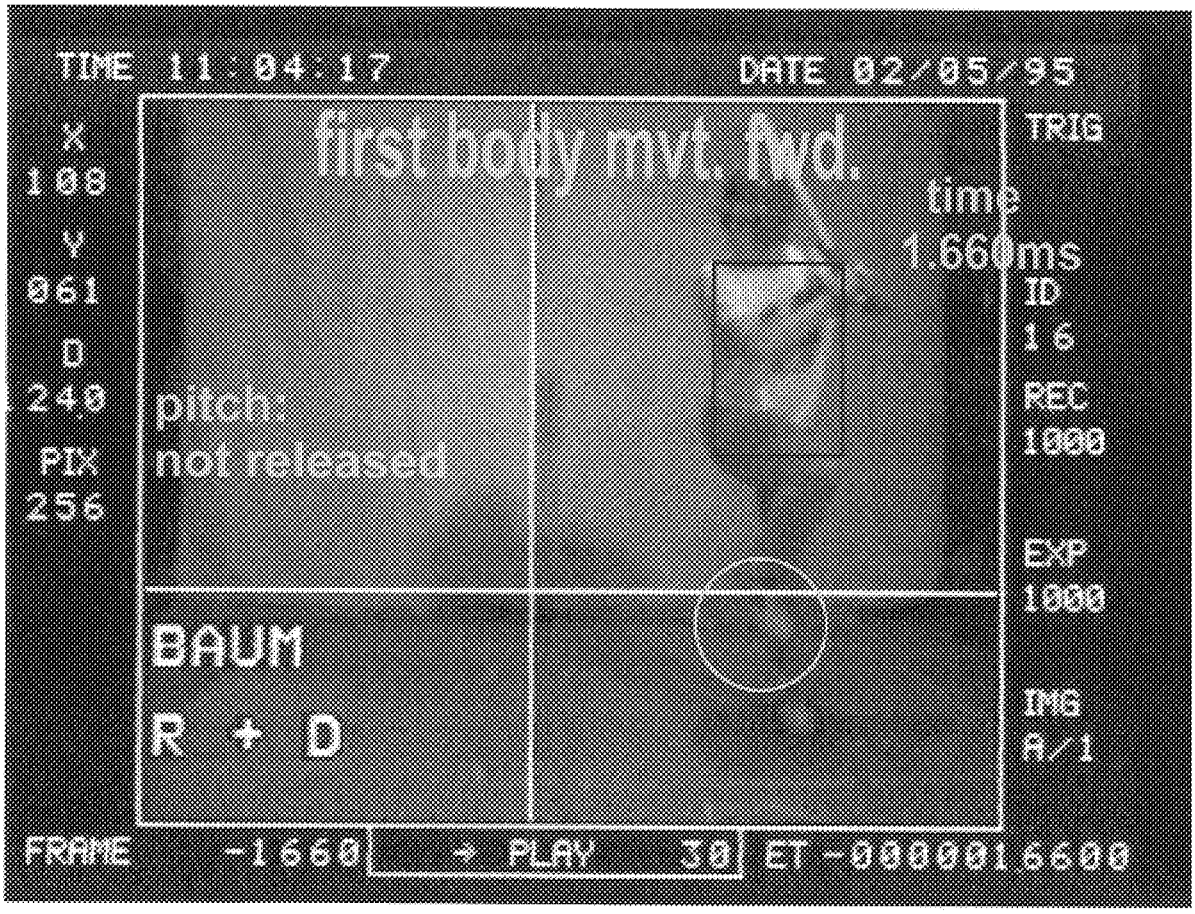
FIGS. 11A–11D depict a variety of batter images captured according to the invention along with statistical data superimposed thereon.
Figure 11B:
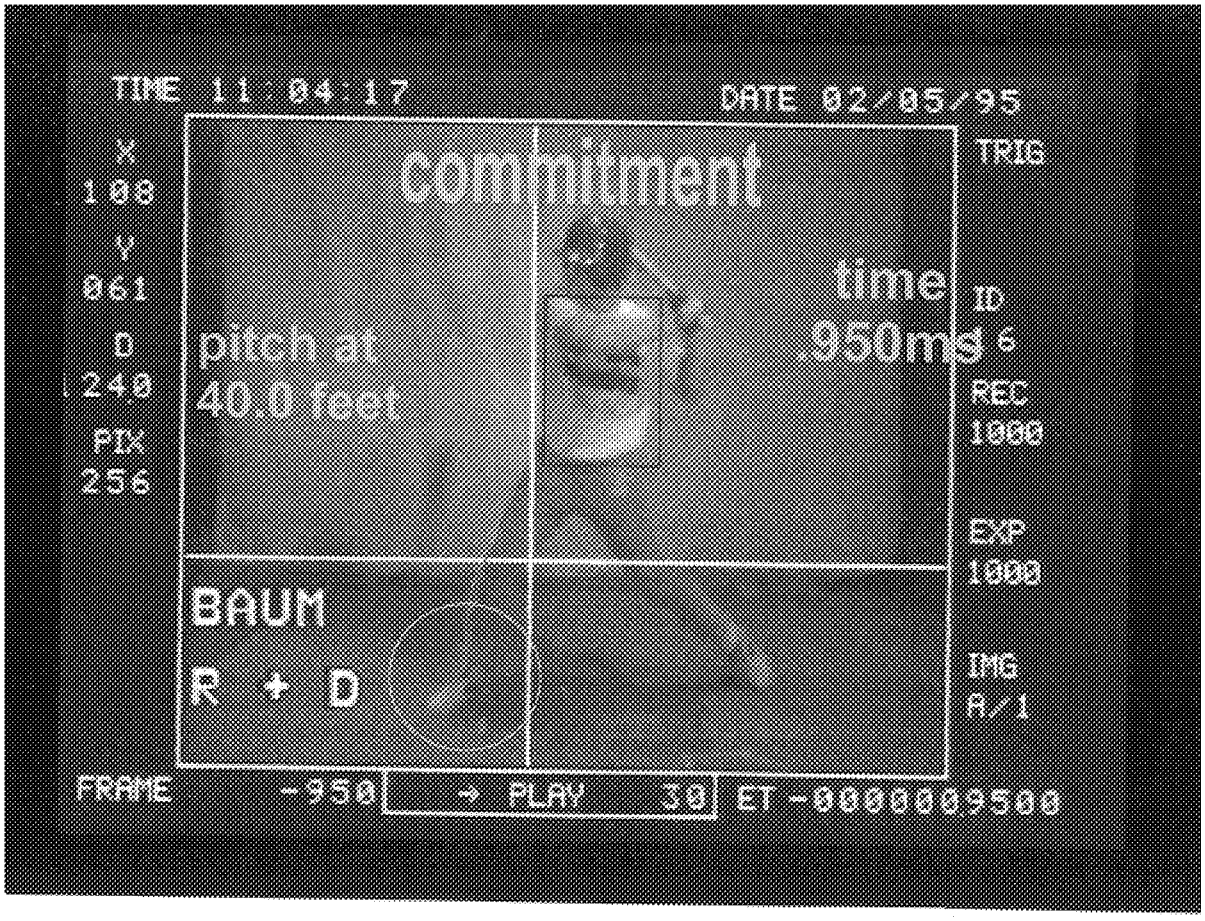
Figure 11C:
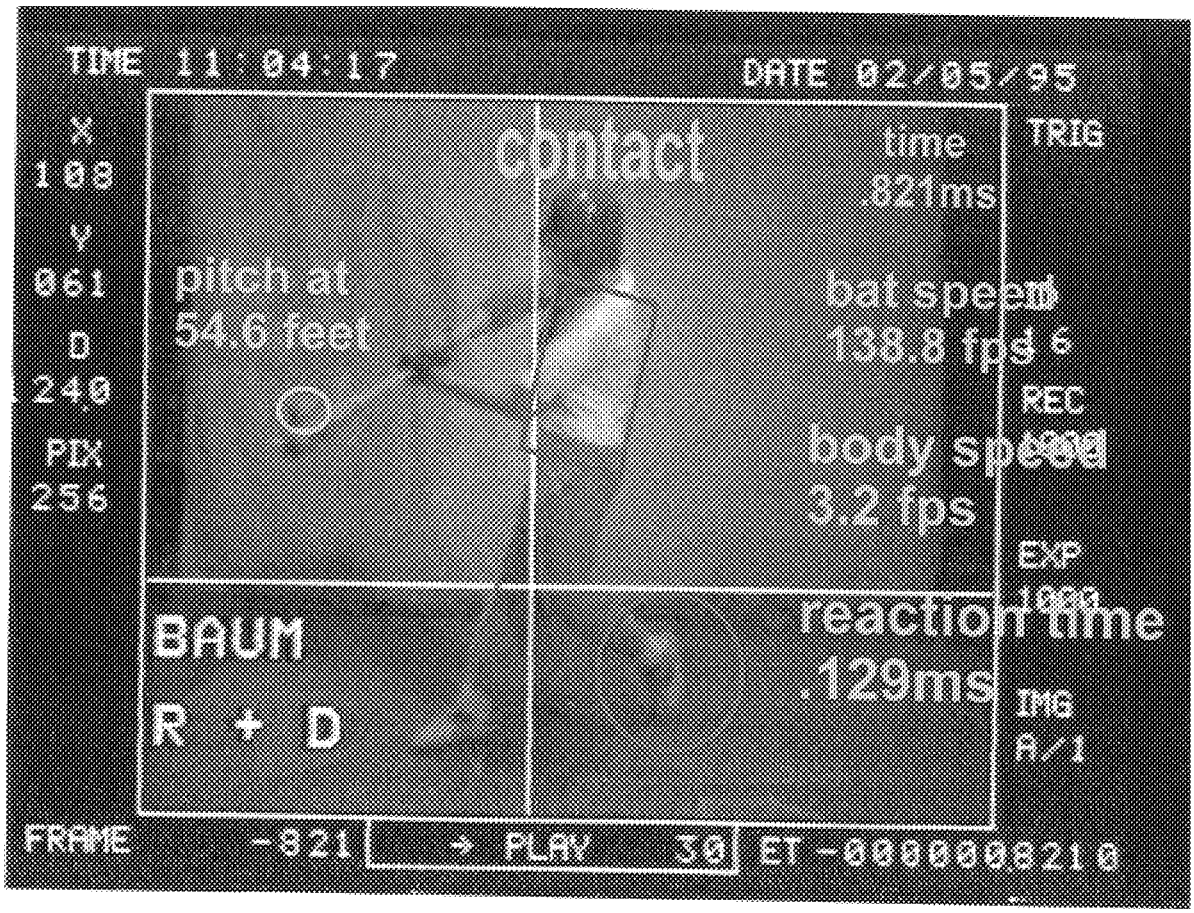
Figure 11D:
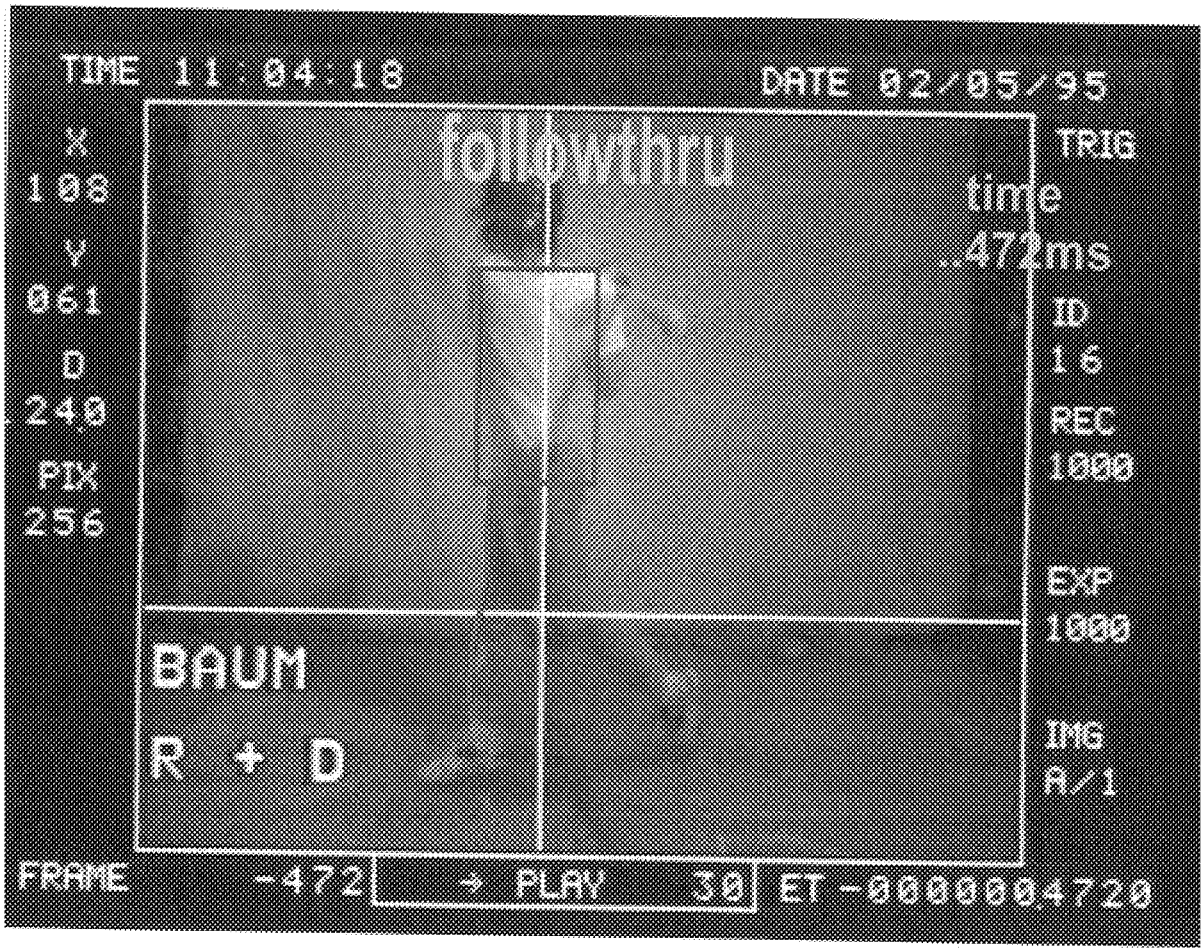

FIG. 6 shows the computer components and functions which accomplish the entering of data as measured by the measurement devices and computation of a performance analysis. The computer programs preferably utilize video image processing computers to provide the pitch and batted ball parameters, which are then passed to the computer database. Bat swing monitor and sensor data are transmitted directly to the computer database where they are processed, and swing parameters and hit locations determined. An analysis program utilizes the data to compute and update performance statistics. FIG. 7 illustrates the various hardware and software components within the system.

All historical data, such as batter identification, can be selected from the database before a test session starts. Details of the test may be monitored by an operator to be sure that the quality of the data is maintained. Results for each pitch and for test analyses are automatically stored but are available for immediate playback and review. A typical database for batter evaluation includes an extensive list of parameters, as detailed in the table of FIG. 8. Data typically fall into three categories, two of which are inputs to the system and one of which is externally derived. The inputs include historical data such as defining batter, bat, and pitcher used for a test. These data are readily available and are transferred to the computer for each batter. The second input to the system is measured data, provided by the measurement devices on the field, such as pitch speed and batted ball speed. The externally derived data may include the previous results of batter performance. Such results determine the size and scope of the database required, the analysis procedures to be followed, and the equipment, computer and software needed to provide them.

In operation, a test sequence according to the invention may proceed as follows: the pitch is thrown and viewed by the video cameras; pitch type and speed are determined and recorded; the batter swings, and if contact is made, contact location on the bat and ball speed before and after contact are computed and recorded; if contact is not made, both a miss and ball location are recorded; if the ball is hit within view of the cameras (typically encompassing fair territory), the batted ball speed and direction are determined and recorded. At this point, the system is ready to accept another pitch. Once the test sequence is completed, the performance statistics are compiled and reported.

The apparatus aspect of the invention may be portable and easily set up. Batter, bat and pitcher data may be entered ahead of time, if known, or on the scene if not known. An operator identifies personnel, enters data if necessary and monitors test progress. When a test is complete, the operator may review the data with an evaluator. When all testing on all batters is completed, the operator may print summary statistics for each batter as a field test report. All test data may be retained in the computer database for comparison with other tests and with other batters. Once baseline data is established under controlled conditions for a given batter, lightweight digital cameras may be subsequently taken into the field to make additional recordings of selected characteristics. FIGS. 11A to 11D depict a variety of batter images captured according to the invention along with statistical data superimposed thereon.

Indeed, the invention may be used to surreptitiously analyze the performance of players without them knowing it, for example, on an opposing team. Although it may be a challenge to incorporate a laser-based bat-swing monitor and/or vibration tester into the playing field, numerous high-speed digital cameras may be used outside of the playing field, for example, with telephoto lenses, along with player or ball isolation software, if required, and analysis software to develop performance statistics on a real-time or historical basis.

I claim:

1. A batter analysis and testing system, comprising:

a plurality of video cameras, each aimed at a batter from a different perspective to record the pitch and hit of a ball by the batter;

a bat swing monitor;

a computer interfaced to the video cameras and to the bat swing monitor; and an application software program resident on the computer to generate batter performance statistics as a function of the pitch, hit, and bat swing.

2. The batter analysis and testing system of claim 1, further including a vibration sensor mounted on the bat and interfaced to the computer, enabling the batter performance statistics to include bat vibration.

3. The batter analysis and testing system of claim 2, wherein the bat includes a sweet sport, and wherein the vibration sensor and computer are operative to determine the hit of the ball relative to the sweet spot.

4. The batter analysis and testing system of claim 2, wherein the interface between the vibration sensor and the computer includes a wireless communication link.

5. The batter analysis and testing system of claim 1, including a first video camera looking down on the batter and a second video camera viewing the batter form the side.

6. The batter analysis and testing system of claim 1, wherein the pitch and hit of the ball recorded by each video camera show the ball against a background, the system further including software to isolate the movement of the ball from the background.

7. The batter analysis and testing system of claim 1, the computer further including a memory for storing previously obtained batter performance statistics, enabling the system to generate a database of history performance for that batter.

8. The batter analysis and testing system of claim 1, wherein the bat swing monitor includes a plurality of light beams which are broken as the batter swings the bat.

9. The batter analysis and testing system of claim 1, further including mechanical means for pitching the ball to the batter.

10. A batter analysis and testing system, comprising:

at least two video cameras to record the pitch and hit of a ball by the batter, one of the cameras being aimed generally downwardly on the batter from overhead and another being aimed at the batter from a side perspective;

a bat swing monitor to measure one or more characteristics associated with the swing of the bat by the batter, including swing speed;

a bat-mounted vibration sensor to determine the point of contact between the ball and bat, including the relation of the contact point to bat's sweet spot;

a computer interfaced to the video cameras, the bat swing monitor, and the bat-mounted vibration sensor, the interface to the bat-mounted vibration sensor including a wireless communication link, the computer including:

an application software program to generate batter performance statistics as a function of the pitch, hit, and bat swing characteristics, and a memory for storing previously obtained batter performance statistics, enabling the system to further generate a database of history performance for that batter.

11. The batter analysis and testing system of claim 10, wherein the pitch and hit of the ball recorded by each video camera show the ball against a background, the system further including software to isolate the movement of the ball from the background.

12. A method of analyzing the performance of a baseball batter, comprising the steps of:

providing a programmed computer having a display and a memory for storing batter performance statistics;

pitching a ball to the batter;

imaging the movements of the batter and the ball just prior to, during, and following contact of the ball by the bat, and storing information in the memory relating to the batter and ball movements;

monitoring the batter's swing of the bat to determine additional bat-swing characteristics, including bat speed, and storing information in the memory relating to such characteristics;

sensing the point of contact between the ball and the bat, and storing information in the memory relating to the contact point;

developing a database of batter performance statistics based upon the pitch, swing and ball-contact information; and displaying a portion of the database in response to an operator request.

13. The method of claim 12, further including the step of receiving historical batter performance statistics, and wherein the step of developing a database of batter performance statistics includes the historical batter performance statistics.

* * * * *